US009570844B1

(12) United States Patent
Wince

(10) Patent No.: US 9,570,844 B1
(45) Date of Patent: Feb. 14, 2017

(54) LUG TERMINALS BLOCK FOR QUICK CONNECTION AND DISCONNECTION

(71) Applicant: Lockheed Martin Corporation, Bethesda, MD (US)

(72) Inventor: Gordon L. Wince, Midlothian, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/685,997

(22) Filed: Apr. 14, 2015

Related U.S. Application Data

(60) Provisional application No. 61/988,488, filed on May 5, 2014.

(51) Int. Cl.

| | |
|---|---|
| ***H01R 11/30*** | (2006.01) |
| ***H01R 13/62*** | (2006.01) |
| ***H01R 9/24*** | (2006.01) |
| ***H01R 43/26*** | (2006.01) |

(52) U.S. Cl.
CPC ..... *H01R 13/6205* (2013.01); *H01R 9/2416* (2013.01); *H01R 43/26* (2013.01)

(58) Field of Classification Search
CPC ..... H01R 11/30; H01R 13/6205
USPC ..... 439/38–40, 305, 129
See application file for complete search history.

(56) References Cited

U.S. PATENT DOCUMENTS

| | | | | |
|---|---|---|---|---|
| 7,419,378 | B2 * | 9/2008 | Ha | G01R 1/0466 439/39 |
| 9,202,615 | B2 * | 12/2015 | Fullerton | H01F 7/0257 |
| 2007/0072443 | A1 * | 3/2007 | Rohrbach | H01R 13/6205 439/39 |

* cited by examiner

*Primary Examiner* — Abdullah Riyami
*Assistant Examiner* — Thang Nguyen
(74) *Attorney, Agent, or Firm* — Withrow & Terranova, PLLC

(57) ABSTRACT

A terminal block is disclosed. The terminal block includes a body that forms a chamber and an opening configured to facilitate passage of a lug terminal from an exterior environment into the chamber. A movable first ferromagnetic object is positioned in the chamber. An electrical contact is exposed to the chamber, and a second ferromagnetic object is configured to magnetically attract the movable first ferromagnetic object in a direction toward the electrical contact.

17 Claims, 12 Drawing Sheets

LUG TERMINALS BLOCK FOR QUICK CONNECTION AND DISCONNECTION

RELATED APPLICATIONS

This application claims the benefit of U.S. Provisional Patent Application No. 61/988,488, filed on May 5, 2014, entitled RING TERMINAL QUICK CONNECT AND DISCONNECT, the disclosure of which is hereby incorporated herein by reference in its entirety.

GOVERNMENT RIGHTS

This invention was made with government funds under contract number W31P4Q-12-C-0001 awarded by PAC-3 MSE IPF. The U.S. Government may have rights in this invention.

TECHNICAL FIELD

The disclosure generally relates to electrical circuit connections, and particularly relates to a terminal block for quick connection and disconnection of one or more lug terminals.

BACKGROUND

A ring lug terminal is a type of electrical connector with a ring metal structure that is crimped at the end of a wire and can be used to electrically couple the wire to a conductive path using a screw and a nut. A spade lug terminal is similar to a ring lug terminal but uses a spade or bi-fork metal structure rather than a ring metal structure.

A terminal block is often used to electrically couple wires with lug terminals to various electrical paths. However, it can be tedious and time-consuming to connect lug terminals to a terminal block. Terminal blocks are often used in test environments to test an electronic device, where the connections need be secure during testing but are not permanent. Thus, the lug terminals are first connected to the terminal block, and the device is tested. The lug terminals are then disconnected from the terminal block. Devices under test may have hundreds of different wires that need to be connected to and then disconnected from the terminal block. Connecting and disconnecting hundreds of lug terminals with respect to a terminal block can take a relatively long period of time, and greatly extends the amount of time it takes to test a device, limiting the number of devices that can be tested in a given period of time.

Accordingly, there is a need for a terminal block that facilitates quick and intuitive connection and disconnection of lug terminals.

SUMMARY

The embodiments relate to a terminal block that utilizes magnets to facilitate relatively fast connection and disconnection of lug terminals to a terminal block.

In one embodiment, the terminal block includes a body that forms a chamber and an opening configured to facilitate passage of a lug terminal from an exterior environment into the chamber. A movable first ferromagnetic object is positioned in the chamber. An electrical contact is exposed to the chamber, and a second ferromagnetic object is configured to magnetically attract the movable first ferromagnetic object in a direction toward the electrical contact.

In one embodiment, the electrical contact comprises both a first surface that is exposed to the chamber, and a second surface. The second ferromagnetic object is fixed to the second surface.

In one embodiment, the movable first ferromagnetic object and the second ferromagnetic object comprise one of neodymium and samarium-cobalt.

In one embodiment, the movable first ferromagnetic object comprises steel, and the second ferromagnetic object comprises one of neodymium and samarium-cobalt.

In one embodiment, the moveable first ferromagnetic object is spheroidal, and has a diameter configured to fit within a ring of a ring lug terminal.

In one embodiment, the movable first ferromagnetic object is cylindrical, and has a bottom portion with an annular beveled edge that is configured to facilitate insertion of the lug terminal between the movable first ferromagnetic object and the electrical contact.

In one embodiment, the movable first ferromagnetic object is cylindrical, and has a bottom portion that has an annular curved edge configured to facilitate insertion of the lug terminal between the movable first ferromagnetic object and the electrical contact.

In one embodiment, the moveable first ferromagnetic object is rectangular, and has a bottom portion that is beveled to facilitate insertion of the lug terminal between the movable first ferromagnetic object and the electrical contact.

In one embodiment, the movable first ferromagnetic object is rectangular, and has a bottom portion that is curved to facilitate insertion of the lug terminal between the movable first ferromagnetic object and the electrical contact.

In one embodiment, the body comprises a side wall that defines a portion of the chamber. The side wall is configured to limit lateral displacement of the movable first ferromagnetic object. The chamber has a height sufficient to allow displacement of the movable first ferromagnetic object in a direction perpendicular to a first surface of the electrical contact to facilitate insertion of the lug terminal between the movable first ferromagnetic object and the electrical contact.

In one embodiment, the body forms a plurality of chambers and a plurality of corresponding openings. Each opening is configured to facilitate passage of a respective lug terminal of a plurality of lug terminals from the exterior environment into a corresponding chamber. The terminal block includes a plurality of movable first ferromagnetic objects, and each movable first ferromagnetic object of the plurality of movable first ferromagnetic objects is positioned in a corresponding chamber of the plurality of chambers. The terminal block further includes a plurality of electrical contacts, and each electrical contact of the plurality of electrical contacts is exposed to a corresponding chamber of the plurality of chambers. The terminal block further includes a plurality of second ferromagnetic objects, and each second ferromagnetic object of the plurality of second ferromagnetic objects is configured to magnetically attract one of the movable first ferromagnetic objects of the plurality of movable first ferromagnetic objects toward a corresponding electrical contact.

In one embodiment, the body forms a second chamber and a second opening that are configured to facilitate passage of a second lug terminal from the exterior environment into the second chamber. A movable third ferromagnetic object is positioned in the second chamber. A second electrical contact is exposed to the second chamber. The second electrical contact is conductively coupled to the first electrical contact. A fourth ferromagnetic object is configured to magnetically attract the movable third ferromagnetic object in a direction toward the second electrical contact.

In another embodiment, a method for forming an electrical connection between a lug terminal and a conductive connector is provided. The method includes inserting the lug terminal into a terminal block, wherein the terminal block comprises a body that forms a chamber and an opening that are configured to facilitate passage of the lug terminal from an exterior environment into the chamber, a movable first ferromagnetic object positioned in the chamber, an electrical contact exposed to the chamber, a second ferromagnetic object configured to magnetically attract the movable first ferromagnetic object in a direction toward the electrical contact, and a fastener configured to secure the conductive connector to the electrical contact. The method further includes securing the conductive connector to the electrical contact via the fastener.

Those skilled in the art will appreciate the scope of the disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first magnet" and "second magnet," and does not imply a priority, a type, an importance, or other attribute, unless otherwise stated herein. The phrase "ferromagnetic object" refers to an object that comprises a material that is magnetized, or is attracted to a magnetized material, such as, by way of non-limiting example, iron, nickel, cobalt, steel, a magnet, a super-magnet, a rare-earth magnet, and the like.

Figure 1:
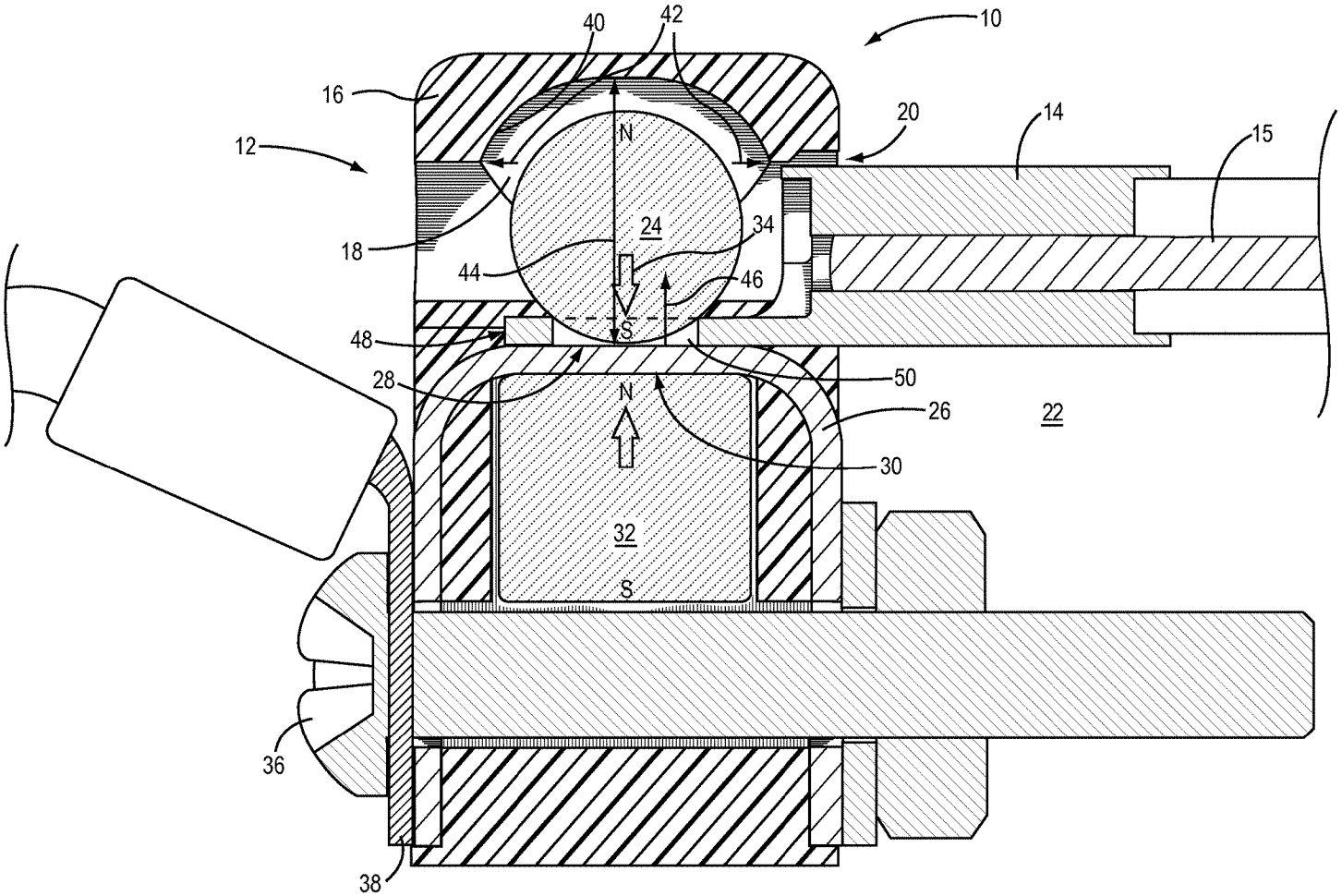
FIG. 1 is a cross-sectional diagram of a terminal block according to one embodiment.

FIG. 1 is a cross-sectional diagram of a terminal block 10 according to one embodiment. The terminal block 10 includes a connection junction 12 that facilitates secure connection of a lug terminal 14 to the terminal block 10. The lug terminal 14 is crimped or otherwise affixed to a conductive medium 15, in this example a wire. The terminal block 10 includes a body 16 that forms a chamber 18 and an opening 20 that is configured to facilitate passage of the lug terminal 14 from an exterior environment 22 into the chamber 18. The lug terminal 14 in this example comprises a ring lug terminal, but the embodiments are not limited to ring lug terminals, and have applicability to any type of lug terminal, including, by way of non-limiting example, spade lug terminals and the like.

The terminal block 10 includes a movable first ferromagnetic object 24 that is positioned in the chamber 18. The movable first ferromagnetic object 24 comprises a magnet, or a material that is attracted to magnets. In one embodiment, the movable first ferromagnetic object 24 comprises a rare-earth material, such as neodymium or samarium-cobalt. In another embodiment, the movable first ferromagnetic object 24 comprises a steel ball. The terminal block 10 also includes an electrical contact 26 that is exposed to the chamber 18. The electrical contact 26 has a first surface 28 that is exposed to the chamber 18 and a second surface 30. A second ferromagnetic object 32 is positioned with respect to the second surface 30 and is configured to magnetically attract the movable first ferromagnetic object 24 in a direction 34 toward the first surface 28 of the electrical contact 26. The second ferromagnetic object 32 may comprise a magnet, or a material that is attracted to magnets. If the movable first ferromagnetic object 24 is not a magnet, then the second ferromagnetic object 32 comprises a magnet. In some embodiments, both the movable first ferromagnetic object 24 and the second ferromagnetic object 32 comprise magnets, such as, by way of non-limiting example, neodymium or samarium-cobalt magnets. Where both the movable first ferromagnetic object 24 and the second ferromagnetic object 32 comprise magnets, it is desirable that the magnetic directions, illustrated throughout the drawings as "N" and "S", are oriented such that the movable first ferromagnetic object 24 and the second ferromagnetic object 32 attract one another. In some embodiments, the second ferromagnetic object 32 is fixed with respect to the second surface 30, such as via an epoxy or other adhesive or fastening mechanism.

The attraction between the movable first ferromagnetic object 24 and the second ferromagnetic object 32 secures the lug terminal 14 with respect to the electrical contact 26. The lug terminal 14 is secured sufficiently to form a conductive path with the electrical contact 26 and to inhibit accidental removal of the lug terminal 14 from the connection junction 12, but can relatively easily be inserted into the opening 20 and relatively easily extracted from the opening 20 as appropriate.

The terminal block 10 includes a fastener 36, in this embodiment a screw, that is configured to secure a conductive connector 38, in this example another ring lug terminal, to the electrical contact 26. In the embodiment illustrated in FIG. 1, an electrical path exists between the conductive connector 38, the electrical contact 26, and the lug terminal 14.

While for purposes of illustration the terminal block 10 comprises a single connection junction 12, in other embodiments, the terminal block 10 may comprise any number of connection junctions 12 and, in some embodiments, may comprise hundreds or thousands of connection junctions 12, to facilitate the quick connection of hundreds or thousands of wires to other conductive paths.

The chamber 18 is defined at least in part by a side wall 40 that is configured to limit lateral displacement of the movable first ferromagnetic object 24 in directions 42. The chamber 18 has a height 44 sufficient to allow displacement of the movable first ferromagnetic object 24 in a direction 46 perpendicular to the first surface 28 of the electrical contact 26 to facilitate insertion of the lug terminal 14 between the movable first ferromagnetic object 24 and the first surface 28 of the electrical contact 26. When the lug terminal 14 is inserted into the opening 20, an edge 48 of the lug terminal 14 contacts the surface of the movable first ferromagnetic object 24, which, in this example, is spheroidal. The edge 48 urges the movable first ferromagnetic object 24 away from the first surface 28, and the side wall 40 limits lateral movement of the movable first ferromagnetic object 24 so that the movable first ferromagnetic object 24 is contained within the chamber 18. As the lug terminal 14 is inserted a sufficient distance into the chamber 18, the magnetic attraction between the movable first ferromagnetic object 24 and the second ferromagnetic object 32 causes the movable first ferromagnetic object 24 to drop into an opening 50 of the lug terminal 14, securing the lug terminal 14 with respect to the electrical contact 26.

Figure 2:
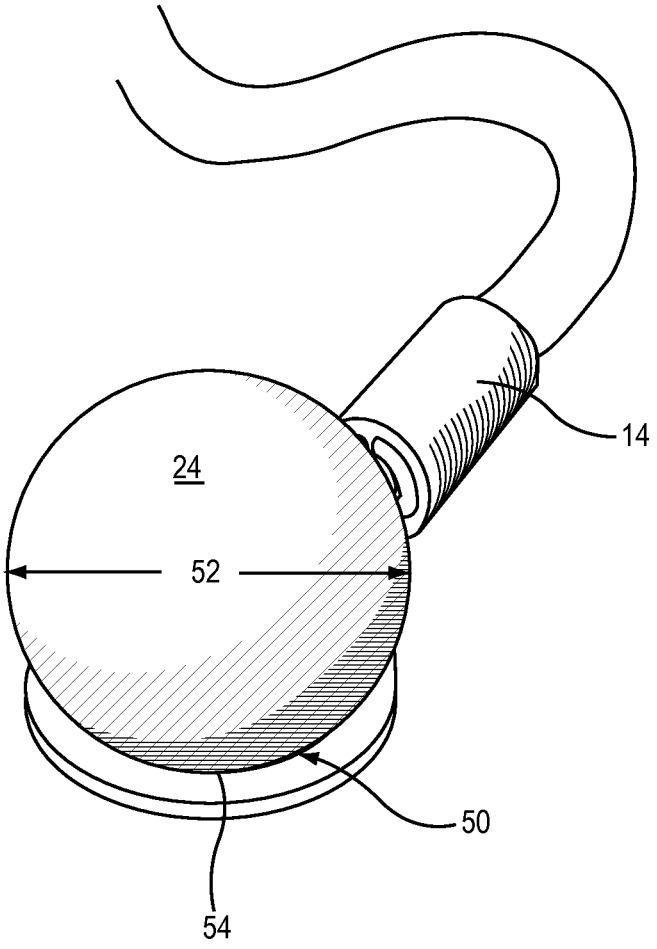
FIG. 2 is a perspective view illustrating a movable first ferromagnetic object and a lug terminal according to one embodiment.

FIG. 2 is a perspective view illustrating the movable first ferromagnetic object 24 and the lug terminal 14 according to one embodiment. The movable first ferromagnetic object 24 is spheroidal, and has a diameter 52 such that the movable first ferromagnetic object 24 fits within the opening 50 and contacts an annular edge 54 of the lug terminal 14 that forms the opening 50. This enables the movable first ferromagnetic object 24 to securely fix the lug terminal 14 to the electrical contact 26 (FIG. 1).

Figure 3:
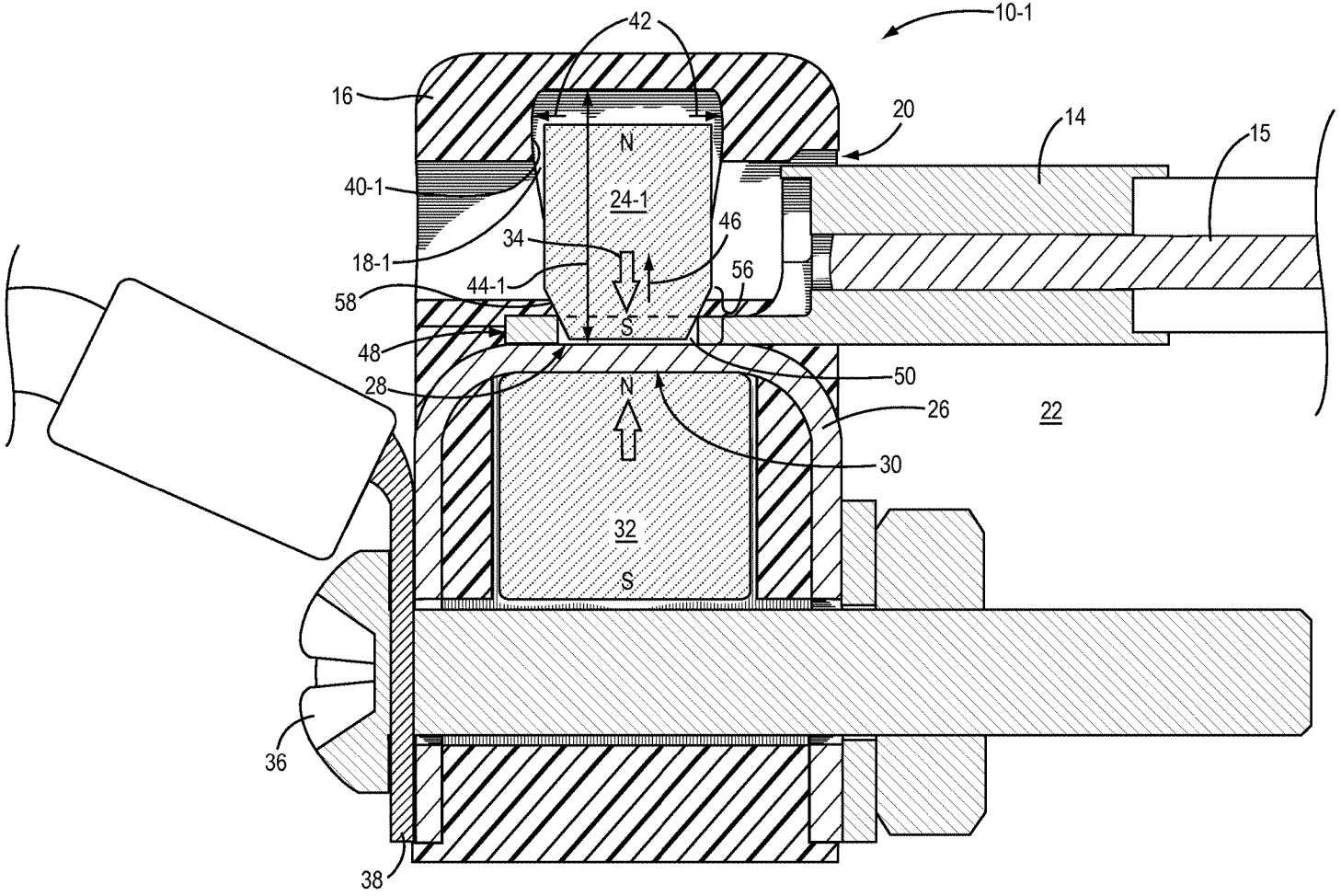
FIG. 3 is a cross-sectional diagram of a terminal block according to another embodiment.

FIG. 3 is a cross-sectional diagram of a terminal block 10-1 according to another embodiment. The terminal block 10-1 is substantially similar to the terminal block 10 except as otherwise discussed herein. In this embodiment, a movable first ferromagnetic object 24-1 is cylindrical and has a bottom portion 56 that has an annular beveled edge 58 configured to facilitate insertion of the lug terminal 14 between the movable first ferromagnetic object 24-1 and the electrical contact 26.

A chamber 18-1 is defined at least in part by a side wall 40-1 that is configured to limit lateral displacement of the movable first ferromagnetic object 24-1 in directions 42. The chamber 18-1 has a height 44-1 that is sufficient to allow displacement of the movable first ferromagnetic object 24-1 in the direction 46 perpendicular to the first surface 28 of the electrical contact 26 to facilitate insertion of the lug terminal 14 between the movable first ferromagnetic object 24-1 and the electrical contact 26. When the lug terminal 14 is inserted into the opening 20, an edge 48 of the lug terminal 14 contacts the annular beveled edge 58 of the movable first ferromagnetic object 24-1. The edge 48 urges the movable first ferromagnetic object 24-1 away from the first surface 28 and the side wall 40-1 limits lateral movement of the movable first ferromagnetic object 24-1 so that the movable first ferromagnetic object 24-1 is contained within the chamber 18-1. As the lug terminal 14 is inserted a sufficient distance into the chamber 18-1, the magnetic attraction between the movable first ferromagnetic object 24-1 and the second ferromagnetic object 32 causes the movable first ferromagnetic object 24-1 to drop into the opening 50 of the lug terminal 14, securing the lug terminal 14 with respect to the electrical contact 26.

Figure 4:
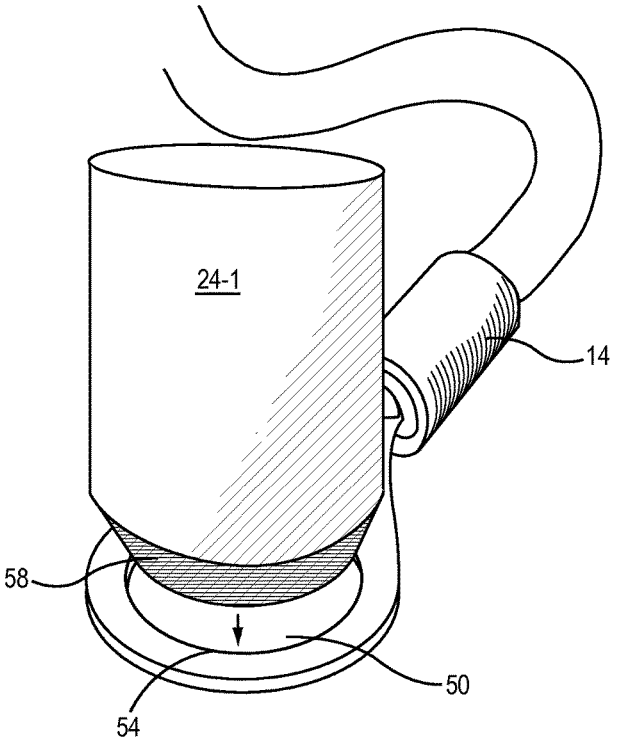
FIG. 4 is a perspective view illustrating a movable first ferromagnetic object and a lug terminal according to one embodiment.

FIG. 4 is a perspective view illustrating the movable first ferromagnetic object 24-1 and a lug terminal 14 according to one embodiment. The movable first ferromagnetic object 24-1 is cylindrical, and has a diameter such that the annular beveled edge 58 fits within the opening 50 and contacts an annular edge 54 of the lug terminal 14 that forms the opening 50. This enables the movable first ferromagnetic object 24-1 to securely fix the lug terminal 14 to the electrical contact 26 (FIG. 3).

Figure 5:
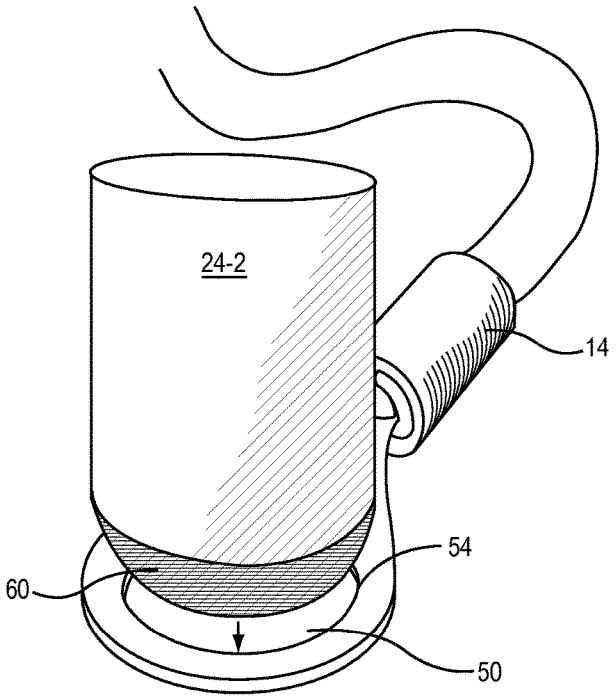
FIG. 5 is a perspective view illustrating a movable first ferromagnetic object and the lug terminal according to another embodiment.

FIG. 5 is a perspective view illustrating a movable first ferromagnetic object 24-2 and the lug terminal 14 according to another embodiment. In this embodiment, the movable first ferromagnetic object 24-2 is cylindrical, and has an annular curved edge 60 that fits within the opening 50 and contacts an annular edge 54 of the lug terminal 14 that forms the opening 50. This enables the movable first ferromagnetic object 24-2 to securely fix the lug terminal 14 to the electrical contact 26 (FIG. 3).

Figure 6A:
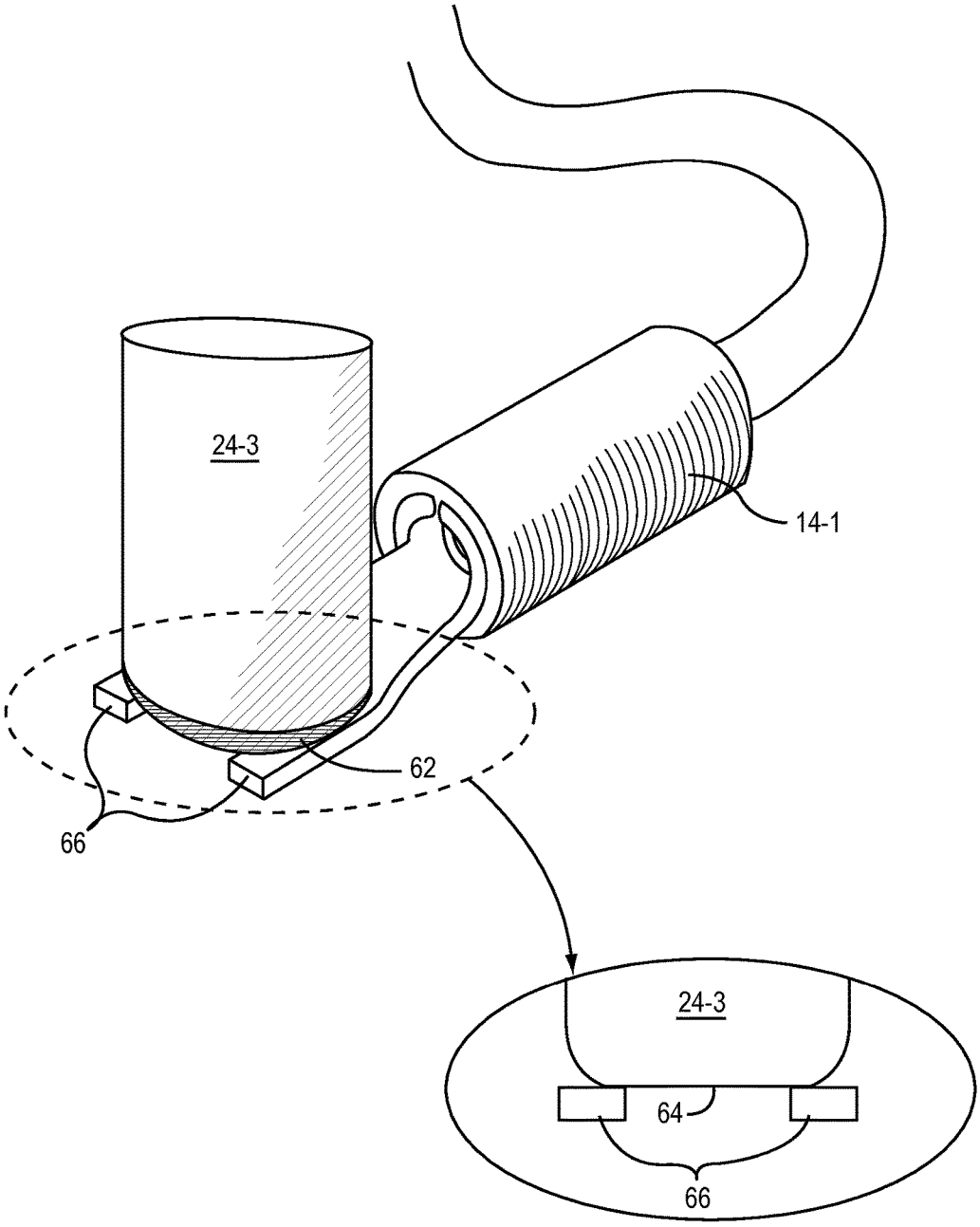
FIGS. 6A-6D illustrate suitable shapes for movable first ferromagnetic objects for use with a spade lug terminal.

FIGS. 6A-6D illustrate suitable shapes for movable first ferromagnetic objects for use with a spade lug terminal 14-1. FIG. 6A illustrates a cylindrical movable first ferromagnetic object 24-3 having an annular curved edge 62 and a bottom surface 64 that allows insertion of the spade lug terminal 14-1 into a suitably shaped chamber. The bottom surface 64 contacts prongs 66 of the spade lug terminal 14-1 and fixes the spade lug terminal 14-1 with respect to the electrical contact 26 (FIGS. 1, 3).

Figure 6B:
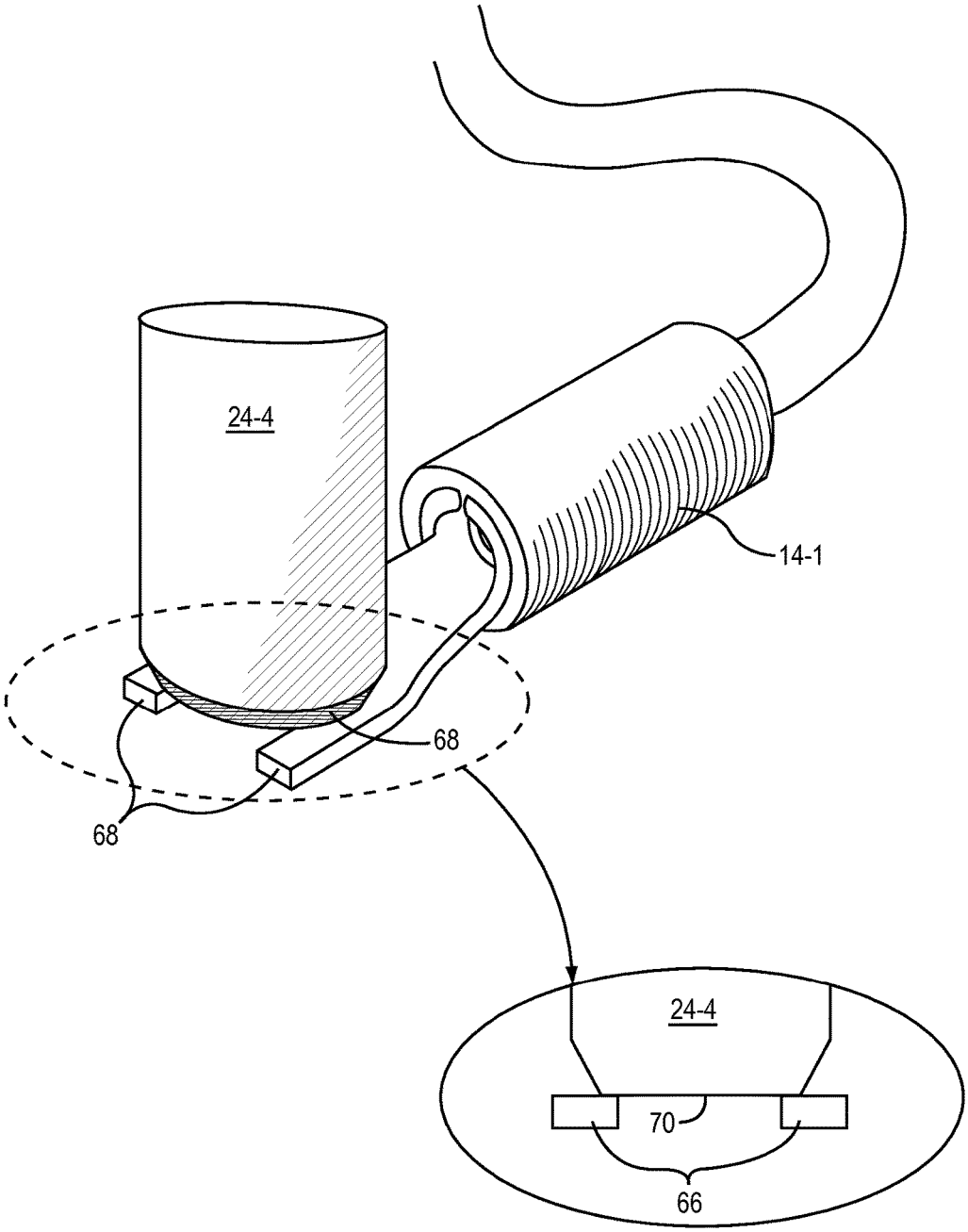

FIG. 6B illustrates a cylindrical movable first ferromagnetic object 24-4 having an annular beveled edge 68 and a bottom surface 70 that allows insertion of the spade lug terminal 14-1 into a suitably shaped chamber. The bottom surface 70 contacts the prongs 66 of the spade lug terminal 14-1 and fixes the spade lug terminal 14-1 with respect to the electrical contact 26 (FIGS. 1, 3).

Figure 6C:
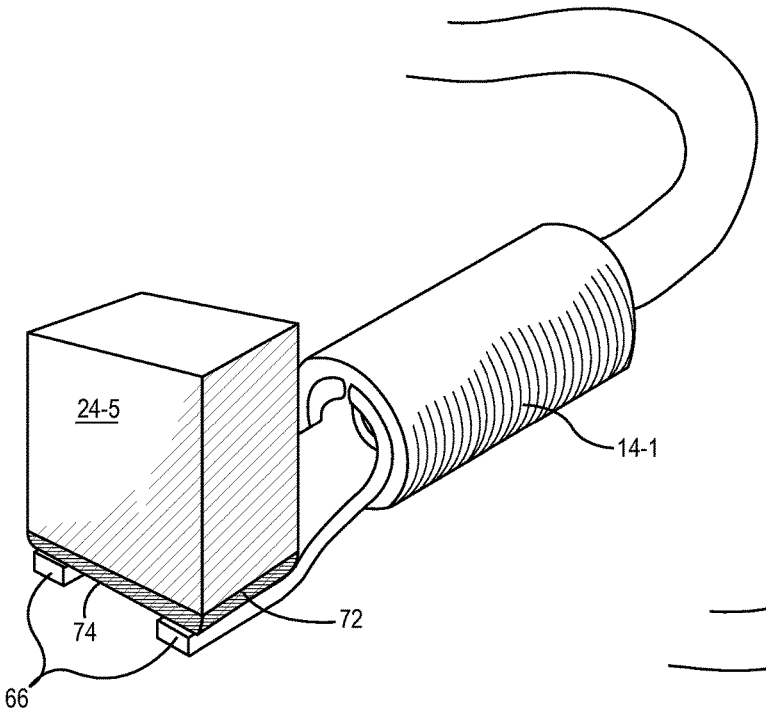

FIG. 6C illustrates a rectangular movable first ferromagnetic object 24-5 having a curved edge 72 and a bottom surface 74 that allows insertion of the spade lug terminal 14-1 into a suitably shaped chamber. The bottom surface 74 contacts the prongs 66 of the spade lug terminal 14-1 and fixes the spade lug terminal 14-1 with respect to the electrical contact 26 (FIGS. 1, 3).

Figure 6D:
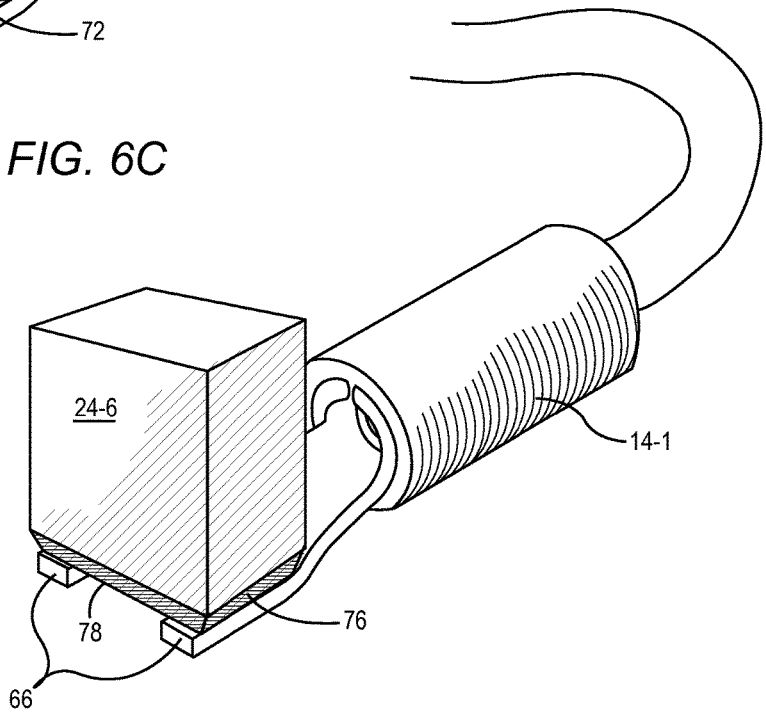

FIG. 6D illustrates a rectangular movable first ferromagnetic object 24-6 having a beveled edge 76 and a bottom surface 78 that allows insertion of the spade lug terminal 14-1 into a suitably shaped chamber. The bottom surface 78 contacts the prongs 66 of the spade lug terminal 14-1 and fixes the spade lug terminal 14-1 with respect to the electrical contact 26 (FIGS. 1, 3).

Figure 7:
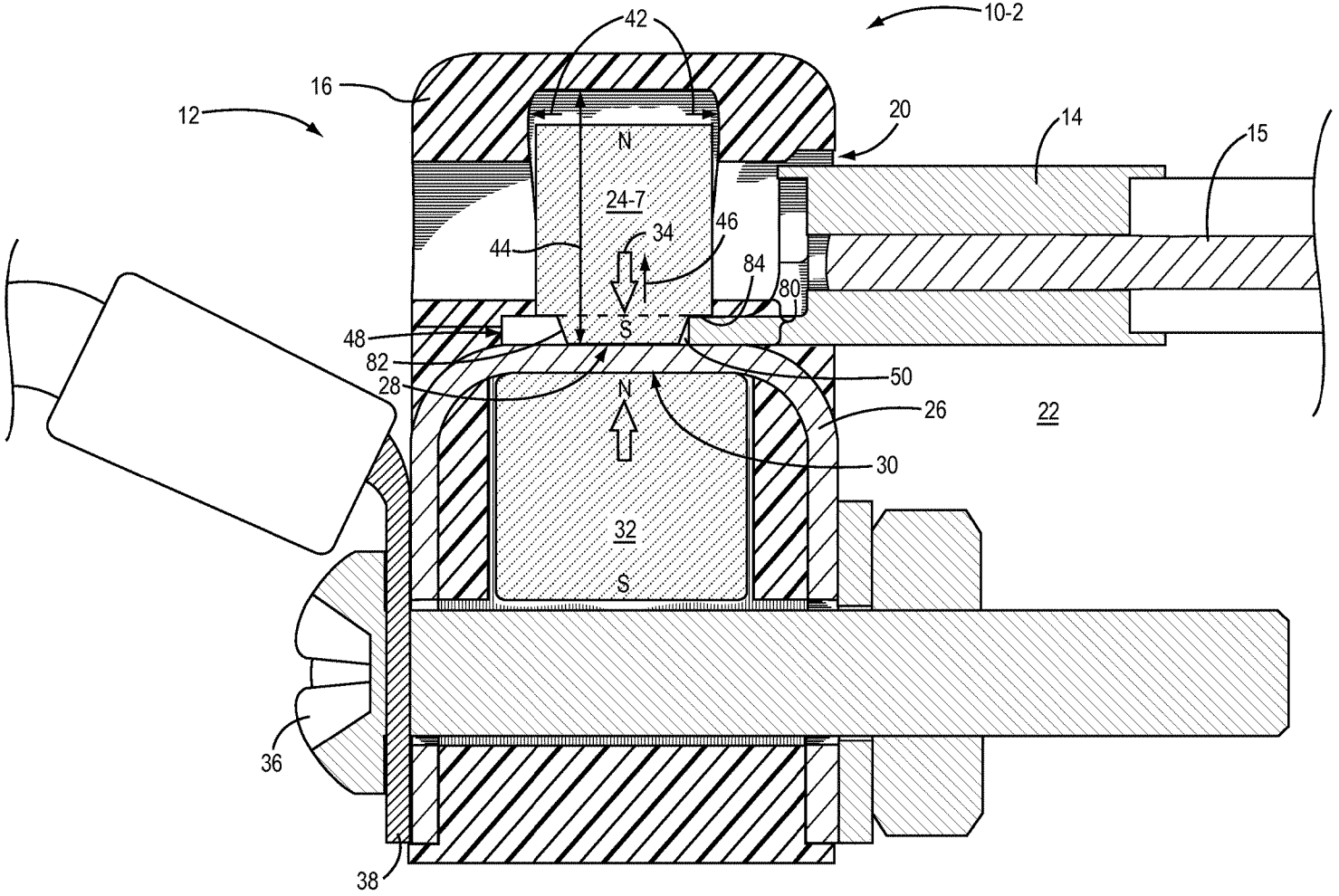
FIG. 7 is a cross-sectional diagram of a terminal block according to another embodiment.

FIG. 7 is a cross-sectional diagram of a terminal block 10-2 according to one embodiment. The terminal block 10-2 is substantially similar to the terminal blocks 10, 10-1 except as otherwise discussed herein. In this embodiment, a movable first ferromagnetic object 24-7 is cylindrical and has a bottom portion 80 that includes a beveled edge 82 and a planar surface 84 that is suited for operation with either a ring lug terminal or a spade lug terminal.

Figure 8:
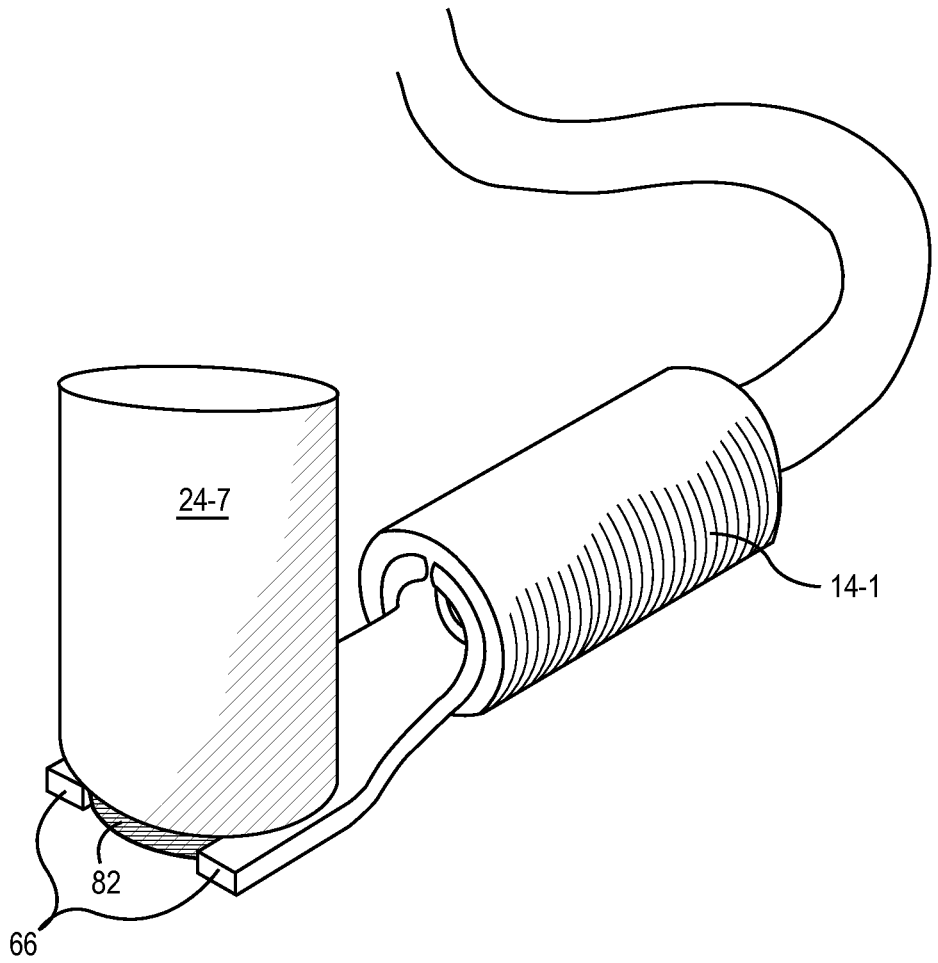
FIG. 8 is a perspective view illustrating a movable first ferromagnetic object and a lug terminal according to another embodiment.

FIG. 8 is a perspective view illustrating the movable first ferromagnetic object 24-7 and the lug terminal 14-1 according to one embodiment.

Figure 9:
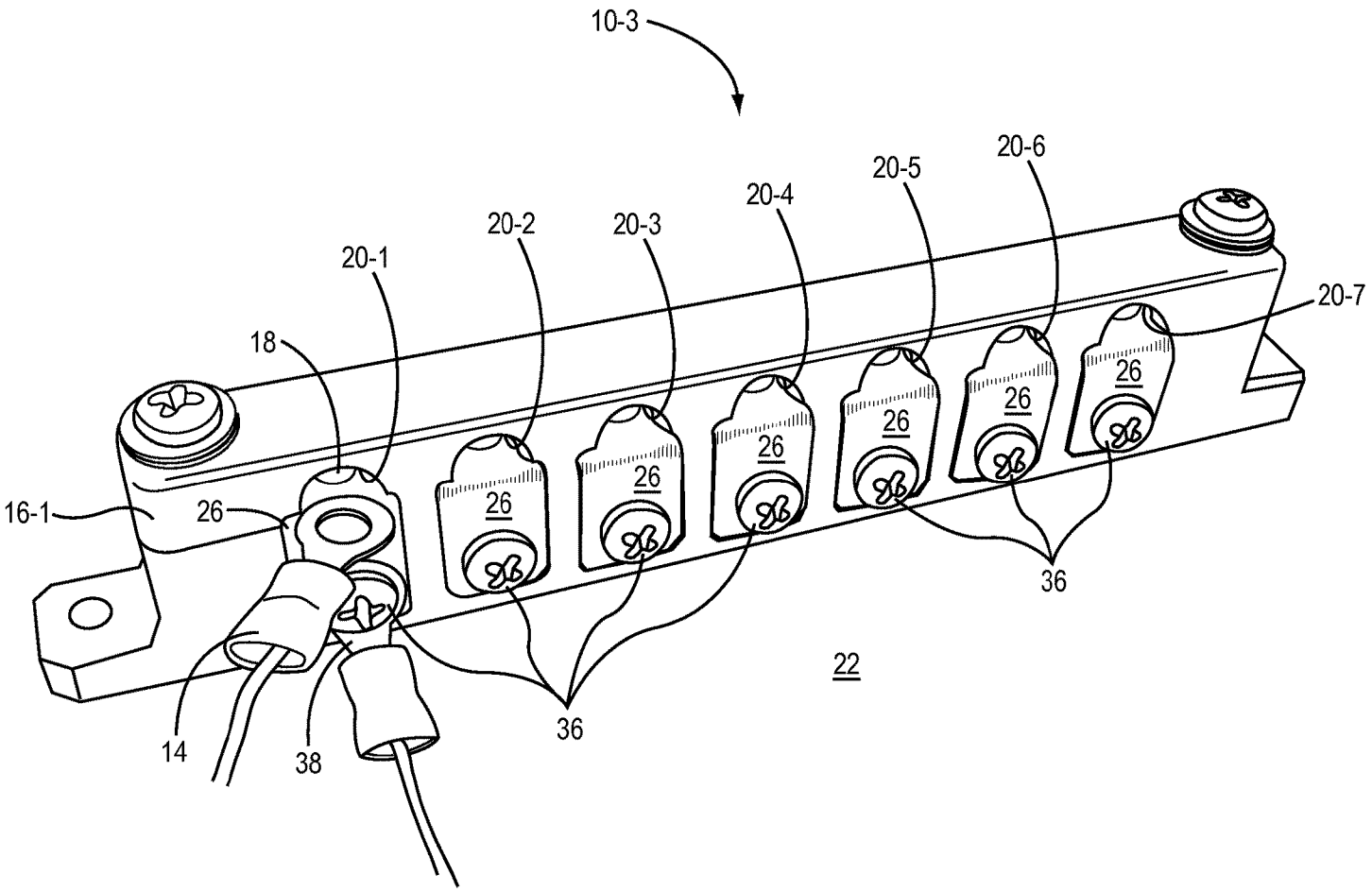
FIG. 9 is a perspective view of a terminal block according to another embodiment.

FIG. 9 is a perspective view of a terminal block 10-3 according to another embodiment. In this example, a body 16-1 forms a plurality of chambers 18 (only partially illustrated) and a plurality of corresponding openings 20-1-20-7 (generally openings 20), each opening 20 configured to facilitate passage of a respective lug terminal 14 (only one illustrated) of a plurality of lug terminals 14 from the exterior environment 22 into a corresponding chamber 18. The terminal block 10-3 includes a plurality of movable first ferromagnetic objects 24 (FIG. 1). Each movable first ferromagnetic object 24 is positioned in a corresponding chamber 18. Each electrical contact 26 is exposed to a corresponding chamber 18. The terminal block 10-3 also includes a plurality of second ferromagnetic objects 32 (FIG. 1). Each second ferromagnetic object 32 is configured to magnetically attract one of the movable first ferromagnetic objects 24 toward a corresponding electrical contact 26. In some embodiments, the magnetic directions of the movable first ferromagnetic objects 24 and the second ferromagnetic objects 32 may be staggered.

The terminal block 10-3 also includes a plurality of fasteners 36 configured to secure a conductive connector 38 of a plurality of conductive connectors 38 to one electrical contact 26 of the plurality of electrical contacts 26.

Figure 10:
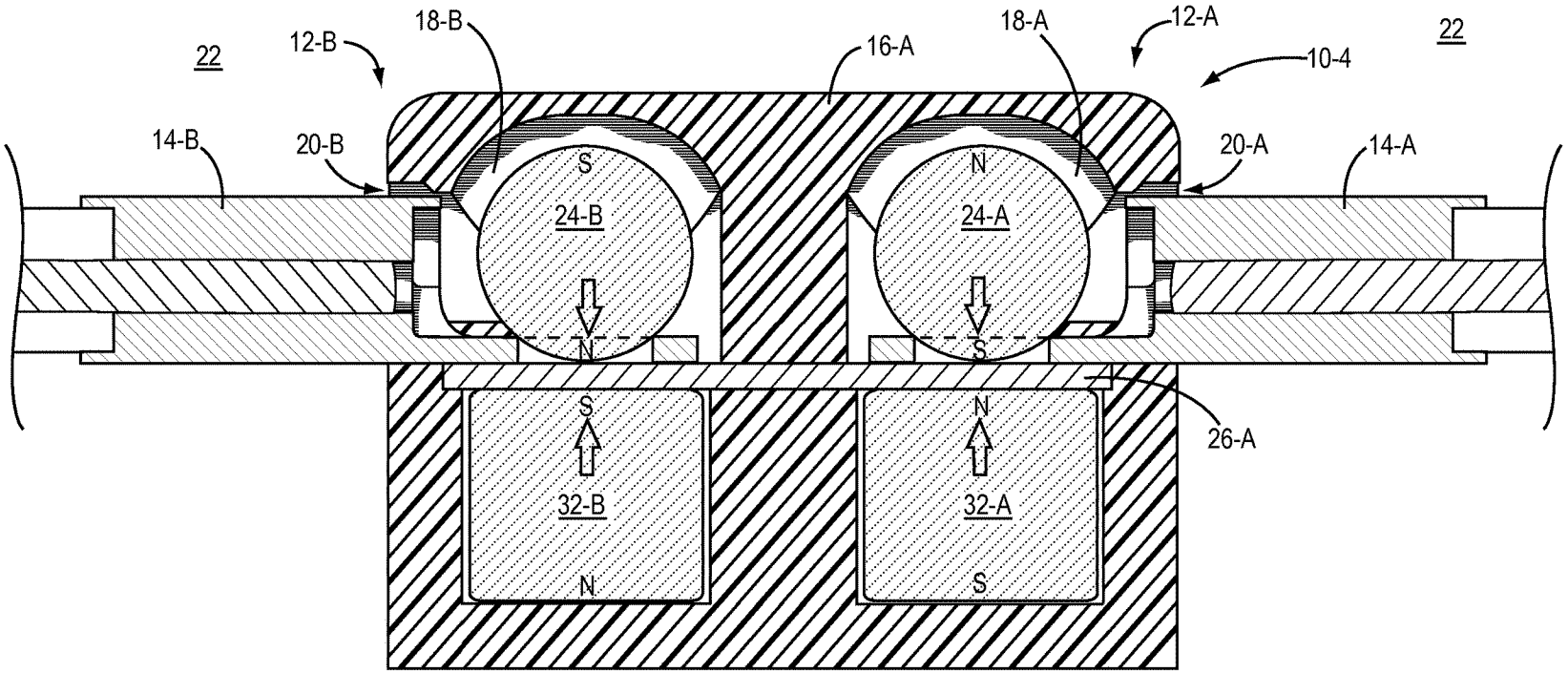
FIG. 10 is a cross-sectional diagram of a terminal block according to another embodiment.

FIG. 10 is a cross-sectional diagram of a terminal block 10-4 according to another embodiment. This embodiment is substantially similar to the terminal block 10 illustrated in FIG. 1, except the terminal block 10-4 contains two connection junctions 12-A and 12-B to allow two lug terminals 14-A, 14-B to be quickly electrically coupled together. In particular, a body 16-A forms a first chamber 18-A, a second chamber 18-B, a first opening 20-A, and a second opening 20-B. The first opening 20-A facilitates passage of a lug terminal 14-A from the exterior environment 22 into the first chamber 18-A, and the second opening 20-B facilitates passage of a lug terminal 14-B from the exterior environment 22 into the second chamber 18-B. A movable first ferromagnetic object 24-A is positioned in the first chamber 18-A, and a movable second ferromagnetic object 24-B is positioned in the second chamber 18-B. In this embodiment, an electrical contact 26-A spans, and is exposed to, the two chambers 18-A, 18-B. A third ferromagnetic object 32-A is configured to magnetically attract the movable first ferromagnetic object 24-A in a direction toward the electrical contact 26-A, and a fourth ferromagnetic object 32-B is configured to magnetically attract the movable second ferromagnetic object 24-B in a direction toward the electrical contact 26-A. In one embodiment, a sufficiently long single ferromagnetic object may be utilized in place of the third and fourth ferromagnetic objects 32-A and 32-B.

Figure 11:
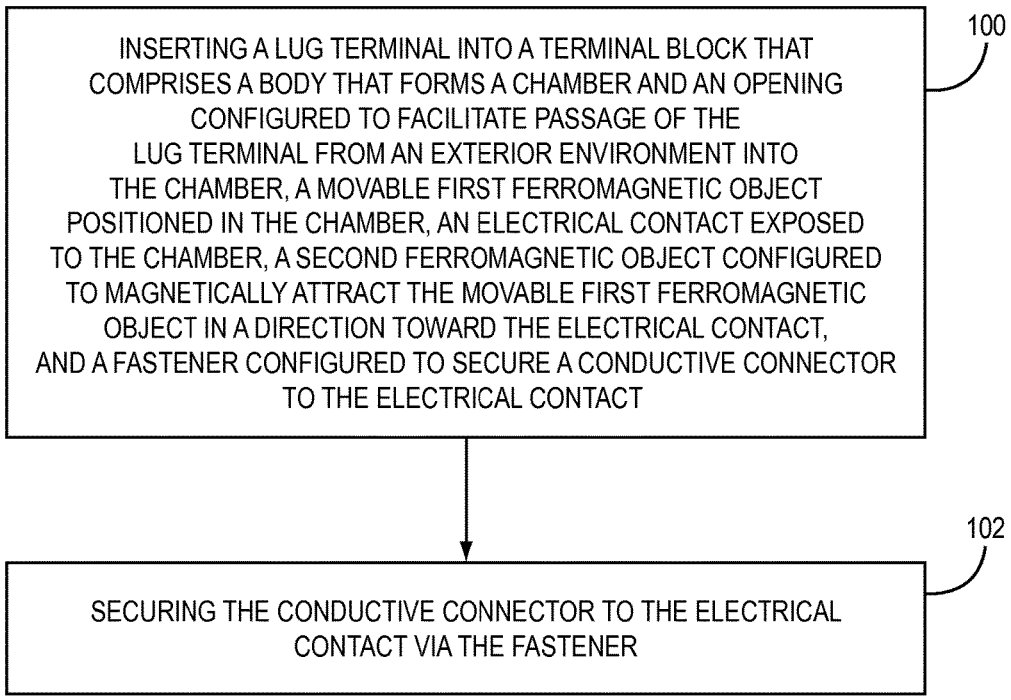
FIG. 11 is a flowchart of a method for forming an electrical connection between a lug terminal and a conductive connector according to one embodiment.

FIG. 11 is a flowchart of a method for forming an electrical connection between a lug terminal and a conductive connector according to one embodiment. FIG. 11 will be discussed in conjunction with FIG. 1. The lug terminal 14 is inserted into the terminal block 10, which comprises the body 16 that forms the chamber 18 and the opening 20 that is configured to facilitate passage of the lug terminal 14 from the exterior environment 22 into the chamber 18. The terminal block 10 also includes the movable first ferromagnetic object 24 positioned in the chamber 18, the electrical contact 26 exposed to the chamber 18, the second ferromagnetic object 32 that is configured to magnetically attract the movable first ferromagnetic object 24 in the direction 34 toward the electrical contact 26, and the fastener 36 that is configured to secure the conductive connector 38 to the electrical contact 26 (block 100). The conductive connector 38 is secured to the electrical contact 26 via the fastener 36 (block 102).

Those skilled in the art will recognize improvements and modifications to the preferred embodiments of the disclosure. All such improvements and modifications are considered within the scope of the concepts disclosed herein and the claims that follow.

What is claimed is:

1. A terminal block comprising:

a body that forms a chamber and an opening configured to facilitate passage of a lug terminal from an exterior environment into the chamber;

a movable first ferromagnetic object positioned in the chamber;

an electrical contact exposed to the chamber; and a second ferromagnetic object configured to magnetically attract the movable first ferromagnetic object in a direction toward the electrical contact to urge the lug terminal against the electrical contact.

2. The terminal block of claim 1, wherein the electrical contact comprises a first surface that is exposed to the chamber, and a second surface, and wherein the second ferromagnetic object is fixed to the second surface.

3. The terminal block of claim 1, wherein the movable first ferromagnetic object and the second ferromagnetic object comprise a rare-earth material.

4. The terminal block of claim 3, wherein the rare-earth material comprises one of neodymium and samarium-cobalt.

5. The terminal block of claim 1, wherein the movable first ferromagnetic object comprises steel, and the second ferromagnetic object comprises one of neodymium and samarium-cobalt.

6. The terminal block of claim 1, wherein the movable first ferromagnetic object is spheroidal, and has a diameter configured to fit within a ring of a ring lug terminal.

7. The terminal block of claim 1, wherein the movable first ferromagnetic object is cylindrical, the movable first ferromagnetic object having a bottom portion that has an annular beveled edge configured to facilitate insertion of the lug terminal between the movable first ferromagnetic object and the electrical contact.

8. The terminal block of claim 1, wherein the movable first ferromagnetic object is cylindrical, the movable first ferromagnetic object having a bottom portion that has an annular curved edge configured to facilitate insertion of the lug terminal between the movable first ferromagnetic object and the electrical contact.

9. The terminal block of claim 1, wherein the movable first ferromagnetic object is rectangular, the movable first ferromagnetic object having a bottom portion that is beveled to facilitate insertion of the lug terminal between the movable first ferromagnetic object and the electrical contact.

10. The terminal block of claim 1, wherein the movable first ferromagnetic object is rectangular, the movable first ferromagnetic object having a bottom portion that is curved to facilitate insertion of the lug terminal between the movable first ferromagnetic object and the electrical contact.

11. The terminal block of claim 1, wherein the body comprises a side wall that defines a portion of the chamber, the side wall configured to limit lateral displacement of the movable first ferromagnetic object, the chamber having a height sufficient to allow displacement of the movable first ferromagnetic object in a direction perpendicular to a first surface of the electrical contact to facilitate insertion of the lug terminal between the movable first ferromagnetic object and the electrical contact.

12. The terminal block of claim 1, further comprising:

a fastener configured to secure a conductive connector to the electrical contact.

13. The terminal block of claim 1, wherein the body forms a plurality of chambers and a plurality of corresponding openings, each opening configured to facilitate passage of a respective lug terminal of a plurality of lug terminals from the exterior environment into a corresponding chamber, the terminal block further comprising:

a plurality of movable first ferromagnetic objects, each movable first ferromagnetic object of the plurality of movable first ferromagnetic objects positioned in a corresponding chamber of the plurality of chambers;

a plurality of electrical contacts, each electrical contact of the plurality of electrical contacts exposed to a corresponding chamber of the plurality of chambers;

a plurality of second ferromagnetic objects, each second ferromagnetic object of the plurality of second ferromagnetic objects configured to magnetically attract one of the movable first ferromagnetic objects of the plurality of movable first ferromagnetic objects toward a corresponding electrical contact.

14. The terminal block of claim 12, further comprising a plurality of fasteners, each fastener configured to secure a conductive connector of a plurality of conductive connectors to one electrical contact of the plurality of electrical contacts.

15. The terminal block of claim 1, wherein the body forms a second chamber and a second opening configured to facilitate passage of a second lug terminal from the exterior environment into the second chamber;

a movable third ferromagnetic object positioned in the second chamber;

a second electrical contact exposed to the second chamber, the second electrical contact conductively coupled to the first electrical contact;

a fourth ferromagnetic object configured to magnetically attract the movable third ferromagnetic object in a direction toward the second electrical contact.

16. A method for forming an electrical connection between a lug terminal and a conductive connector comprising:

inserting the lug terminal into a terminal block, the terminal block comprising:

a body that forms a chamber and an opening configured to facilitate passage of the lug terminal from an exterior environment into the chamber;

a movable first ferromagnetic object positioned in the chamber;

an electrical contact exposed to the chamber;

a second ferromagnetic object configured to magnetically attract the movable first ferromagnetic object in a direction toward the electrical contact to urge the lug terminal against the electrical contact; and a fastener configured to secure the conductive connector to the electrical contact; and securing the conductive connector to the electrical contact via the fastener.

17. A terminal block comprising:

a body that forms a chamber and an opening configured to facilitate passage of a lug terminal from an exterior environment into the chamber;

a movable first ferromagnetic object and a second ferromagnetic object;

an electrical contact fixed to the body and exposed to the chamber and positioned between the movable first ferromagnetic object and the second ferromagnetic object; and wherein:

the movable first ferromagnetic object is positioned in the chamber and is configured to move in a first direction away from the electrical contact upon passage of the lug terminal into the chamber; and the second ferromagnetic object is configured to magnetically attract the movable first ferromagnetic object in a second direction toward the electrical contact to urge the lug terminal against the electrical contact.

* * * * *